US005482024A

United States Patent [19]

Elliott

[11] Patent Number: 5,482,024

[45] Date of Patent: Jan. 9, 1996

[54] COMBUSTION ENHANCER

[76] Inventor: Robert H. Elliott, Box 519, Plymouth, Mich. 48170

[21] Appl. No.: 604,801

[22] Filed: Oct. 29, 1990

Related U.S. Application Data

[63] Continuation-in-part of Ser. No. 364,541, Jun. 6, 1989, abandoned.

[51] Int. Cl.[6] ..... F02M 33/02; F02M 17/22; F02M 21/02

[52] U.S. Cl. ..... 123/516; 123/520; 123/522; 123/525

[58] Field of Search ..... 123/516–521, 123/522–525

[56] References Cited

U.S. PATENT DOCUMENTS

| | | | |
|---|---|---|---|
| 339,177 | 4/1886 | Herlehy et al. | 123/522 |
| 1,629,898 | 5/1927 | Williams | 123/522 |
| 2,565,767 | 8/1951 | Gaskell, Jr. | 123/522 |
| 3,515,107 | 6/1970 | Joyce | 123/520 |
| 3,617,034 | 11/1971 | Skinner | 123/518 |
| 3,926,168 | 12/1975 | Csicsery | 123/519 |
| 3,935,850 | 2/1976 | King | 123/520 |
| 3,949,720 | 4/1976 | Zipprick et al. | 123/518 |
| 3,957,025 | 5/1976 | Heath et al. | 123/518 |
| 3,977,379 | 8/1976 | Weissenbach | 123/518 |
| 3,982,391 | 9/1976 | Reynolds | 123/180 AC |
| 4,059,081 | 11/1977 | Kayanuma | 123/520 |
| 4,085,721 | 4/1978 | Vardi et al. | 123/520 |
| 4,175,526 | 11/1979 | Phelan | 123/520 |
| 4,270,505 | 6/1981 | Johnson | 123/523 |
| 4,275,697 | 6/1981 | Stoltman | 123/520 |
| 4,312,317 | 1/1982 | Jewett et al. | 123/522 |
| 4,326,489 | 4/1982 | Heitert | 123/520 |
| 4,368,712 | 1/1983 | Jackson et al. | 123/523 |
| 4,377,142 | 3/1983 | Otsuka et al. | 123/520 |
| 4,412,521 | 11/1983 | Silva, Jr. | 123/522 |
| 4,426,984 | 1/1984 | Gilbert | 123/522 |
| 4,467,769 | 8/1984 | Matsumura | 123/520 |
| 4,550,691 | 11/1985 | McWade | 123/3 |
| 4,567,871 | 2/1986 | Ma | 123/523 |
| 4,664,087 | 5/1987 | Hamburg | 123/520 |
| 4,683,861 | 8/1987 | Breitkreuz et al. | 123/458 |
| 4,705,007 | 11/1987 | Plapp et al. | 123/520 |
| 4,741,318 | 5/1988 | Kortge et al. | 123/520 |
| 4,836,173 | 6/1989 | Stires, Jr. | 123/522 |
| 4,846,135 | 7/1989 | Tiphaine | 123/520 |
| 4,913,121 | 4/1990 | Shimomura et al. | 123/520 |
| 4,926,825 | 5/1990 | Ohtaka et al. | 123/520 |
| 5,002,033 | 3/1991 | Housand, Sr. | 123/522 |
| 5,005,550 | 4/1991 | Bugin, Jr. et al. | 123/520 |
| 5,020,503 | 6/1991 | Kanasashi | 123/520 |
| 5,054,453 | 10/1991 | Onufer | 123/522 |
| 5,054,454 | 10/1991 | Hamburg | 123/520 |
| 5,090,388 | 2/1992 | Hamburg et al. | 123/520 |
| 5,143,040 | 9/1992 | Okawa et al. | 123/520 |

*Primary Examiner*—E. Rollins Cross
*Assistant Examiner*—Thomas Moulis

[57] ABSTRACT

The proposed invention is directed to a new and unique method and apparatus for obtaining improved fuel economy from an internal combustion engine. This result is incorporated into a commercially installed fuel delivery system for an internal combustion engine that utilizes a volatile liquid fuel supply tank in which an evaporated gaseous state fuel is generated and contained therein. This gaseous state fuel is then drawn from the fuel tank liquid supply source and thereafter delivered into the induction air path of the said engine. An electronically operated fuel/air mixture means is used to provide controlled, variable volumes of evaporated gaseous state fuel for the operation of said engine. In the event that additional vaporized fuel is desirable and/or necessary, a commercially manufactured liquid vaporizing means may be used in addition to the evaporated gaseous state fuel for the operation of said internal combustion engine.

The use of such as electronically controlled fuel delivery system functions to provide optimum fuel/air ratio mixtures under the various engine operating conditions, while at the same time obtaining maximum performance, driveability and economy from the vehicle on which this new and unique dual state fuel delivery system is installed.

34 Claims, 4 Drawing Sheets

COMBUSTION ENHANCER

RELATED APPLICATIONS

This application is a continuation-in-part of application Ser. No. 07/364,541, filed Jun. 6, 1989, and now abandoned.

BACKGROUND

While the internal combustion engine has been in existance for many years, its operating efficiency was of very little concern until the advent of the fuel shortage brought about by the Arabs in 1973. With this, the Environmental Protection Agency (EPA) was brought into full bloom as a necessary and operating part of our government. The public then had an awareness of the inefficiency of many of our mass produced energy consuming products. The need for more efficient automobile engines was very apparent, as was the environmental contamination which the automobile was creating because of its poor efficiency. Although the automotive industry has spent billions of dollars in an attempt to resolve the engine fuel efficiency problem, they have elected to downsize vehicles and engines. In so doing, safety and comfort have been sacrificed. The legislated Corporate Average Fuel Economuy (CAFE) standards are not being adhered to, even though "Ward's Automotive Reports", indicate that for the 1985 model year, over one-half of the cars built in the United States had small engines.

If we were to go to the root of the problem, we will have to examine the operation of the carburetor and the fuel injection systems that are currently being sold. We can observe that a carburetor delivers metered quantities of vaporized liquid fuel in the form of a spray having a wide variety of droplet sizes. As the spray moves through the manifold, the smaller low inertia droplets divide and become air-borne and follow the air currents in the manifold, while the larger and heavier droplets tend to travel in a substantially straight line. Thus, the larger droplets are unable to negotiate curves and are deposited on the inner surface of the mainfold. This method of liquid fuel vaporization leaves a great deal to be desired. Under the best of conditions, an internal combustion engine uses only a little over twenty five percent (25%+) of the energy in a gallon of gasoline. During ordinary driving in the city or during the winter, it may be even less than ten percent (10%–), which is better than most other ways of producing power.

To improve power output, throttle body and multi-port electronic fuel injectors have been developed and are now commercially available. Although the fuel injectors are more efficient than the carburetors in the delivery of minute vaporized liquid droplets in higher quantity, fuel vaporization still remains a serious problem and hampers the devolvement of more economical and efficient engines.

In reference to the above, if an internal combustion engine were to receive a perfect evaporated gaseous state fuel mixture, wherein the gaseous state fuel was uniformly mixed and distributed throughout the induction air, the resulting combustion would probably have a lower compression temperature, a reduced tendency to knock, as well as a higher volumetric efficiency. This is true because air would not be displaced by vaporized liquid fuel droplets on the intake stroke of the engine. Additionally, the evaporated gaseous state fuel/air mixture would tend to remain homogeneous while turning corners in the mainfold, thus eliminating collisions with and condensation on the inner surfaces of the manifold. This condition exists when liquid fuel is inadequately vaporized. It must also be remembered that the large, high inertia droplets of unvaporized liquid the large, high inertia droplets of unvaporized liquid fuel are basically non-combustible, with the result that they may be exhausted from the tailpipe. The unvaporized liquid fuel may also find its way into the crankcase, where it will dilute the lubricating oil and reduce its lubricity. It is possible that some of the liquid fuel may burn to some degree, leaving gum, varnish and hard carbon deposits throughout the engine. This of course is very detrimental to very efficient engine operation. Additionally, if the fuel air ratio is leaned a small amount, a reduction in exhaust gases occurs, because most of the HC and CO will be burned within the combustion chamber. This will reduce the temperature problem in the exhaust manifold, where the excess liquid fuel and gases are usually consumed. This being the case, the $NO_x$ emissions will also be reduced. It will also be noted that production electronic fuel injection systems are now available from a number of both domestic and foreign manufacturers, and with proper revision and adjustment, the engines fuel system can be electronically operated in several modes to obtain maximum fuel efficiency under all operating conditions.

The following description delineates a new method and apparatus for improving the fuel economy of an internal combustion engine by maximization of liquid fuel vaporization. This will operate to minimize the vaporization problems that are normally encountered when using a carburetor and/or an electronically controlled liquid fuel metering and vaporizing injector system, although one of the above identified and described fuel delivery systems may be used in conjunction with the evaporated gaseous state fuel delivery system that is taught in the accompanying specification and appended claims. The proposed, new and unique dual state fuel delivery system will not only extend the working life of the fuel system and engine, it will also reduce the cost of engine maintenance at the same time.

THE DRAWINGS

In the drawings, we see a composite view of the proposed new and unique invention, which embodies several varieties of this new fuel delivery system, differing results being obtained by the deletion and addition of the various elements illustrated in differing combinations, although each system described is complete and functional, while the sophistication of the fuel delivery system will ultimately be determined by the manufacturer.

FIG. 1 illustrates the first embodiment of the invention.

FIG. 2 of the drawings is a diagrammatic view of a Ford Motor Company throttle body fuel injector having a secondary evaporated gaseous state fuel delivery system cooperable therewith for the simultaneous controlled delivery of a liquid fuel vaporized mist, as.

Figure 4:
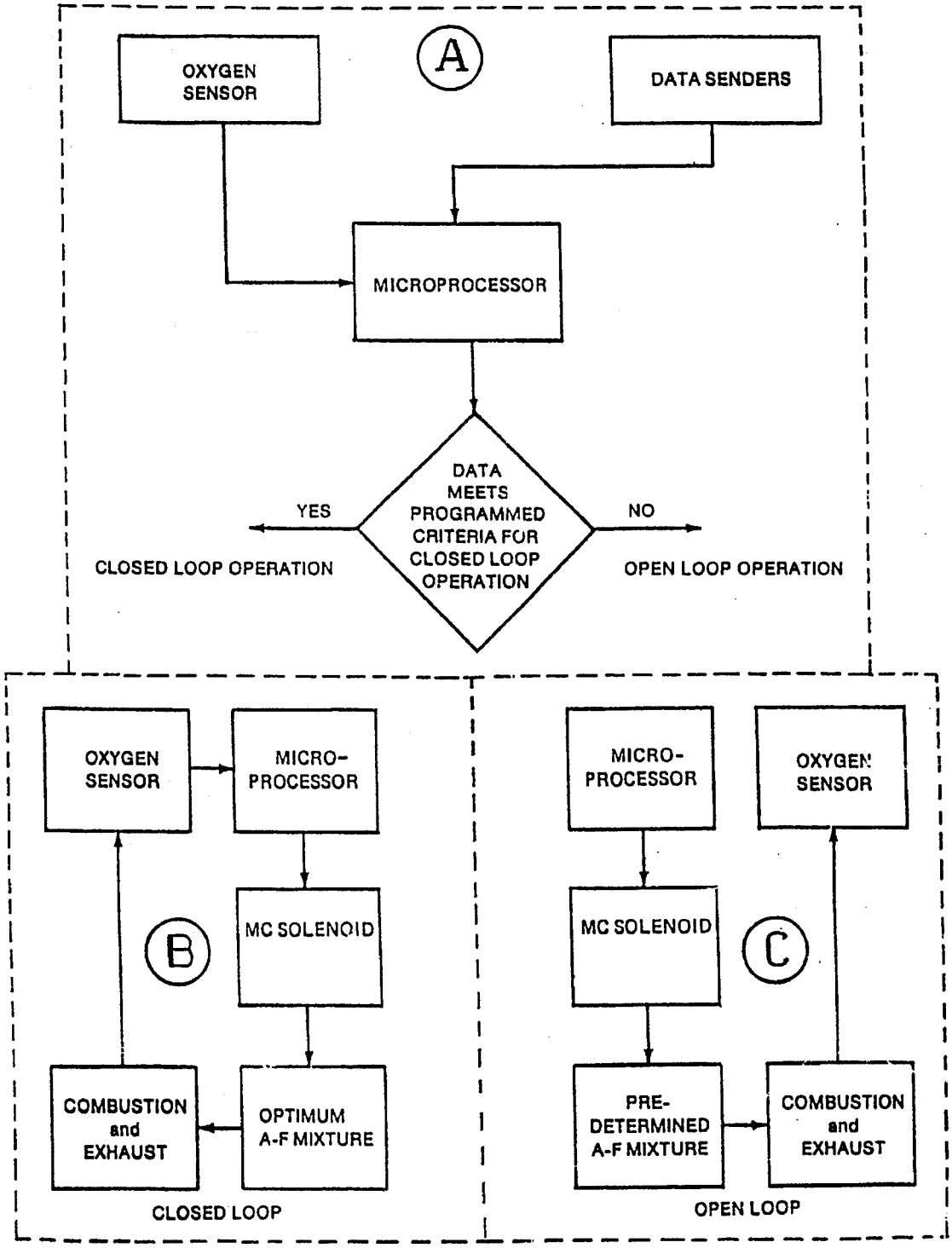
FIG. 4 is a diagramatic illustration of an electronic fuel delivery system, incorporating parts A, B, & C.
Figure 5:
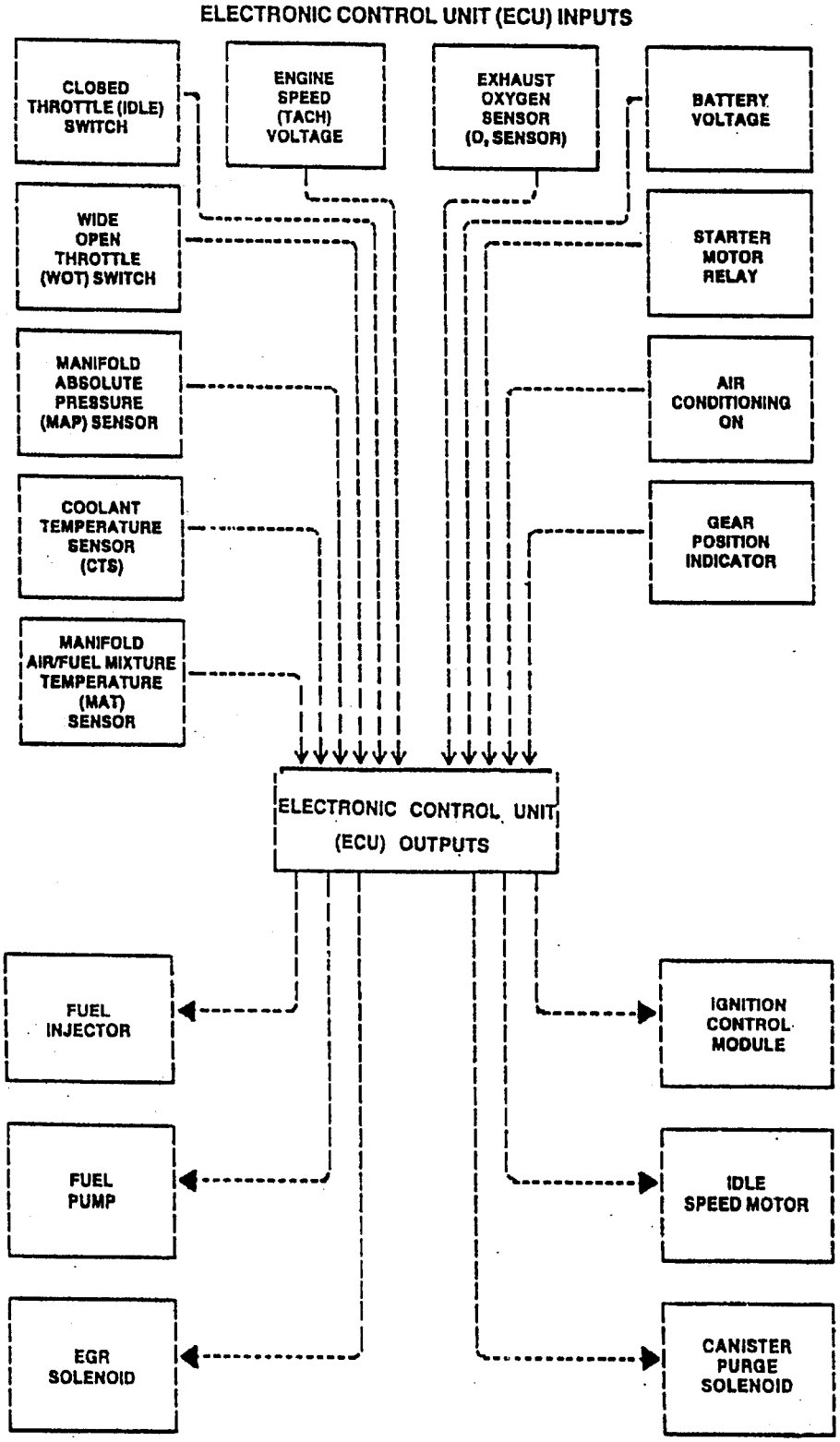

FIG. 5 diagrams the Electronic Control Unit (ECU) Inputs and the Electronic Control Unit Outputs to control the system shown in FIG. 4.

THE INVENTION

The proposed invention about to be described, delineates a new dual state fuel delivery system in several forms, each of which will improve both carbureted, as well as the available electronically controlled domestic and foreign fuel injection systems that have already been marketed. It will however be necessary to modify the existing fuel systems by the addition of a secondary evaporated air born gaseous state fuel delivery means for the delivery of same into the engine to enhance combustion efficiency, improve fuel economy and reduce exhaust gas emissions at the same time.

In this unique development, it will be noted that all commercially available feedback fuel delivery systems of both domestic and foreign origin will require some relatively minor modification and revision of both the mechanical and electronic components incorporated therein. If we examine the diagramatic drawing, we will observe a feedback fuel delivery means 10, which could be either a carburetor or a throttle body fuel injector (TBFI). Each system will provide the best fuel/air mixture for combustion under both open and closed loop modes of engine operation. However, when the carburetor has an electronic mixture control solenoid (MCS) positioned therein, the fuel delivery system will operate in substantially the same manner as the TBFI, since the fuel injector also has an electronically operated mixture control solenoid (MCS). Thus, it will now be very obvious that the use of an electronically controlled fuel system will more accurately meter the liquid fuel spray delivered. In practice, a fuel pump will deliver liquid fuel from fuel tank 12 through a tube 14 known as a fuel rail, which in turn is connected to a return tube 16, so that any unused liquid fuel can be returned to the fuel supply tank 12. A pre-determined liquid fuel pressure is maintained in the fuel rail 14 by at least one submerged electric pump 18. The pump 18 is located inside the fuel tank 12, although an external pump (not shown) could be used in place of, or in combination with submerged pump 18. The use of a submerged pump 18 minimizes any potential vapor lock on the suction side of the fuel delivery system 10. Liquid fuel filters in the system (not shown) protect the pressure regulator (not shown) and mixture control solenoid(s) MCS from damage. Both of the above identified elements are well known in the art.

There are two (2) modes of operation used in the above described feedback fuel delivery systems, which are known as open and closed loop. In general, the delivery system will operate in open loop whenever the engine operating conditions do not conform to the pre-programed menu criteria necessary for closed loop operation. Thus, the fuel/air mixture is maintained at a pre-selected ratio because the output data from the oxygen sensor 32 is being rejected by the electronic control module (ECM) 30 during open loop mode of operation. The open loop mode of operation occurs with cold engine start-up, low coolant temperature, when the engine idles, as well as when the oxygen sensor 32 temp is low and at wide open throttle. When the input data to the electronic control module (ECM) 30 conforms to the pre-programed menu criteria for closed loop operation, the output voltage of the oxygen sensor 32 is accepted by the ECM 30. Closed loop operation then permits delivery of the optimum fuel/air ratio mixture for the operation of said engine, with necessary corrections being made as operating conditions are changing.

Mechanical displacement of the accelerator pedal 40 functions to displace and rotate the butterfly valve 42 which forms the throttle plate. Thus, displacement of the throttle plate butterfly 42 operates the throttle position sensor 46 on the throttle shaft 44, sending a signal to the ECM 30. This in turn relays a signal to the mixture control solenoid MCS for the delivery of vaporized fuel to the engine. Depending on conditions, the engine will be operated in either open or closed loop. The butterfly assembly 50 has been deleted, so that the area above the mixture control solenoid MCS is open to the air cleaner assembly 20, without obstruction. The above general description delineates the basic operational characteristics of electronic feedback fuel delivery systems, which will be modified to incorporate the proposed dual state system.

It will be necessary to install, position and secure one end of a flexible or rigid communicating means 62, having an internal area substantially equal to the fuel/air inlet, with the outer are being less than the area of the induction air path, to the housing 24 of the fuel delivery means 10. The opposite end 64 of the large communicating means 62 is secured to the liquid fuel tank 12, in communication with the evaporated gaseous state fuel 26 contained therein. Additionally, it will be necessary install a closure valve 37 (shown in phantom) in the communicating passage 62, which will be operated by the ECM 30, at the same time the activated charcoal canister valve 37 in the fuel delivery path is operated, which will prevent the escape of gaseous fumes into the atmosphere. An actuatable, normally closed umbrella type, electronically controlled valve (not shown), as well as the butterfly valve assembly 50 shown, could be substituted for the closure valve 37. Either of the above described valves can be operated mechanically, electrically or with vacuum without departing from the intent of the invention. Thus, with a cold start of the internal combustion engine, the electronic fuel delivery system 30 will operate in the open loop mode until the pre-selected menu criteria is satisfied, after which the engine will operate in the closed loop mode, to compensate electronically for the unmetered evaporated gaseous state-fuel/air that has been drawn from the fuel tank 12 via inlet 64, outlet 66 and into the engine thru the large pipe 62. The suction created in the fuel tank 12 has the potential to collapse the said fuel tank 12, however, to prevent this occurrence, an atmospheric air vent and check valve assembly 70 has bene installed on the tank 12. The check valve air inlet 72 outside tank 12, while the outlet thereof 74 can be exhausted beneath the liquid fuel by thermostatic control in the winter, while it may be exhausted above the volatile liquid fuel at other times. The atmospheric vent assembly 70 is suitably controlled during engine operation and closed at other times to limit the escape of fumes into the atmosphere. The turbulence created by air entering the liquid fuel beneath its surface acts to enhance the evaporative process. When and if the evaporated gaseous fuel entering the engine should become overly rich, the reduced voltage generated by the oxygen sensor 32 will function the ECM 30 to actuate the second butterfly assembly 50, or the umbrella valve (not shown) to lean the fuel/air mixture by the addition of additional air through the air cleaner assembly 20. One method shown for introducing additional air is that of a reversible electric motor 54, which is controlled by the ECM 30. As the need occurs, displacement of the butterfly valve 52 on shaft arm 56S and motor control arm 58M is determined by the lack of voltage output from the oxygen sensor 32.

Another method of eliminating the collapse of fuel tank 12 is to exhaust the generated volatile fuel vapors using an engine belt driven air pump assembly 80. This will eliminate need to add the additional atmospheric air vent means 72 depending on the pump output capacity. The belt driven pump may be operated continuously or intermittently and controlled by the ECM 30. In one instance the ECM operates an air control valve 98, while in another instance operates an electromagnetic clutch (not shown). The air pump may be of high volume, low pressure, or high pressure, low volume, with good results. When the belt driven pump is being operated, foreign material, dirt, etc., is separated therefrom by a centrifugal filter fan. Clean air is delivered into the liquid fuel through passage 86, check valve 92 and outlet 96. When control valve 88 is used, the generated signal from the ECM 30 closes the normally open valve 88 when the engine is operating during periods of deceleration and when the pump output pressure exceeds that of the safety relief valve (not shown) and ports the output to atmosphere through a silencer. When a electromagnetic clutch is used to operate the pump, the ECM actuates the clutch at the same time it actuates the solenoid valve on the activated charcoal canister in the gaseous fuel/air delivery path 62. While vacuum vales 78 and 98 are shown operating valves 72 and 88, solenoid valves could be substituted therefore, as well as combinations of both.

The evaporative process can be further enhanced by the installation of several capillary plates positioned in the fuel tank 12. The plates are disposed both above and below the surface of the liquid contained therewithin. In addition, the unused return fuel in line 16 can be directed over the top edges of the several plates 102.

A heat exchanger that is electrically heated or heated with the engine coolant and thermostatically controlled may be effectively employed also, the evaporative process above would be most beneficial during the winter months, though not illustrated in the drawings.

In the drawing we see a second activated carbon canister 110, the first canister having been installed under the vehicles hood at the time of it manufacture. The large fuel delivery pipe 62 has insulation therearound and is shown broken away, although the insulation may be over the full length of the pipe to minimize the potential of any gaseous fuel 26 condensation on the inner walls thereof.

The drawing also shows an electrical solenoid valve 36 between the fuel delivery pipe 62 and the inlet passage 38 into the engine. The ECM 30 actuates valve 36 which is normally closed, to deliver gaseous fuel 26 below throttle plate 42, when the engine is operating above idle-speed. The solenoid valve 36 is de-energized and closes when the engine is inoperative, as well as when a high vacuum occurs during deceleration. Should gaseous fuel delivery below the throttle plate 42 be found undesirable for any reason, solenoid valve 36 and the gaseous fuel passage line 38 can be deleted from the system. The induction air intake may be ionized, as well as heated before mixing with the evaporated unmetered gaseous state fuel 26. Additionally, ultrasonic atomization may be incorporated into the fuel delivery system when liquid fuel vaporization from another source is used.

With further reference to the drawings, it will be noted that the air cleaner assembly 20 may have contained therein a moisture absorbent/desiccant material 28 on the outer surface thereof, while immediately adjacent thereto on the inside is a flame arrestor 34. The same basic structure may also be found below the diaphragm valve 78 on the fuel supply tank 12. Additionally, flame arrestors 68 are installed or in the fuel filler 60, as well as in both gaseous fuel supply lines 38 and 62.

In tests conducted on two (2) 1985, 4 door Buick sedans, #1 being a Buick Century with a 2.5 L engine and a vehicle weight of 2750#, the 190 2 car being a Buick Park Avenue with a 3.8 L engine and a vehicle weight of 3450#, some seven hundred pounds (700#) heavier, and with a fifty-two percent (52%) larger engine, we were able to accomplish the following:

EPA rated 26 MPG overall and 32 MPG highway, we were able to get 29.7 MPG and 37.5 MPG on the #1 vehicle. Improvement +14% and +17.25% over EPA rating.

#2 vehicle

EPA rated 21 MPG overall and 26 MPG highway, we were able to get 24.97 MPG and 31.87 MPG Improvement +19% and +22.6% over EPA rating.

#1 vehicle, throttle body injection, the #2 vehicle, multi-port fuel injection, with air conditioning operating at all times. The test results represent a substantial increase in fuel economy, without any detrimental effects on performance or driveability. These results were obtained without enhancement of the evaporative process, but by merely passing atmospheric air over the liquid fuel in a partially filled fuel supply tank. Evaporative enhancement will improve the fuel economy even more!

In the modified multi-hydrocarbon base fuel blend under consideration, it is believed that during combustion of the fuel/air mixture there is a sequential preferential pyrolysis, coupled with a synergistic release mechanism, which produces an increased energy output resulting from a more complete decomposition of the fuel. The mechanism of the sequential preferential pyrolysis is predicated on the sequential detonation of the fuel, with an almost instant decomposition of each of the components. The rate of the reaction is limited or otherwise controlled by the number of reacting molecules and the rate of molecular collisions. The fuel/air mixture density also influences the number and rate of the molecular collisions, as does heat. Thus, if the temperature is high, the molecular energy is high and the rate of molecular collisions is high and the potential number of new molecules formed by the collisions is substantially increased. Thus, in the combustion chamber of an internal combustion engine, the fuel/air mixture is heated in the manifold, drawn into the combustion chamber, compressed, ignited and decomposed in a very minute fraction of a second. Spontaneous reactions of the fuel/air mixture in an actual engine begin early in the compression stroke and continue at an accelerated rate, as the temperature and pressure increase due to the sudden release of chemical energy. The reaction liberates and forms decomposition products in sequence and allows multiple reaction compatibility, with a consequent high energy output. The sequential reactions aid in the total synergistic decomposition of the base fuel and the formation of by-products that extend the combustion cycle.

In connection with modified fuels, it is possible to enhance performance with higher energy output fuel, wherein better vaporization is accomplished as a result the addition of at least one non-petroleum liquid, which non-petroleum liquid is blended into the fuel supply so as to produce a more efficient gaseous fuel from the new solution. Such a utilitarian non-petroleum quantities. Acetone readily mixes with gasoline and when added in proper amounts will permit the addition of lower boiling point petroleum products without substantially increasing the vapor pressure of the resulting mixture.

Additionally, any moisture carried out the fuel as a result of the introduction of undried atmospheric air would be absorbed in the acetone and consumed in the combustion process.

Another high energy fuel can be producted by the addition of acetone and acetylene to gasoline. The addition of acetylene is accomplished using a columnar container having a vented, but closed top. Acetylene gas is then introduced into the column at the base thereof and bubbled therethrough and absorbed prior to reaching the upper surface of the contained liquid. The volume of gas absorbed is dependent on the quantity of acetone introduced into the gasoline.

In the proposed dual state fuel delivery system, gaseous fuel is introduced in the closed loop mode, while the ECM 30 will permit the controlled entry of evaporated gaseous fuel momentarily when the ignition switch is energized under temperature controlled cold start conditions in the open loop mode.

Figure 1:
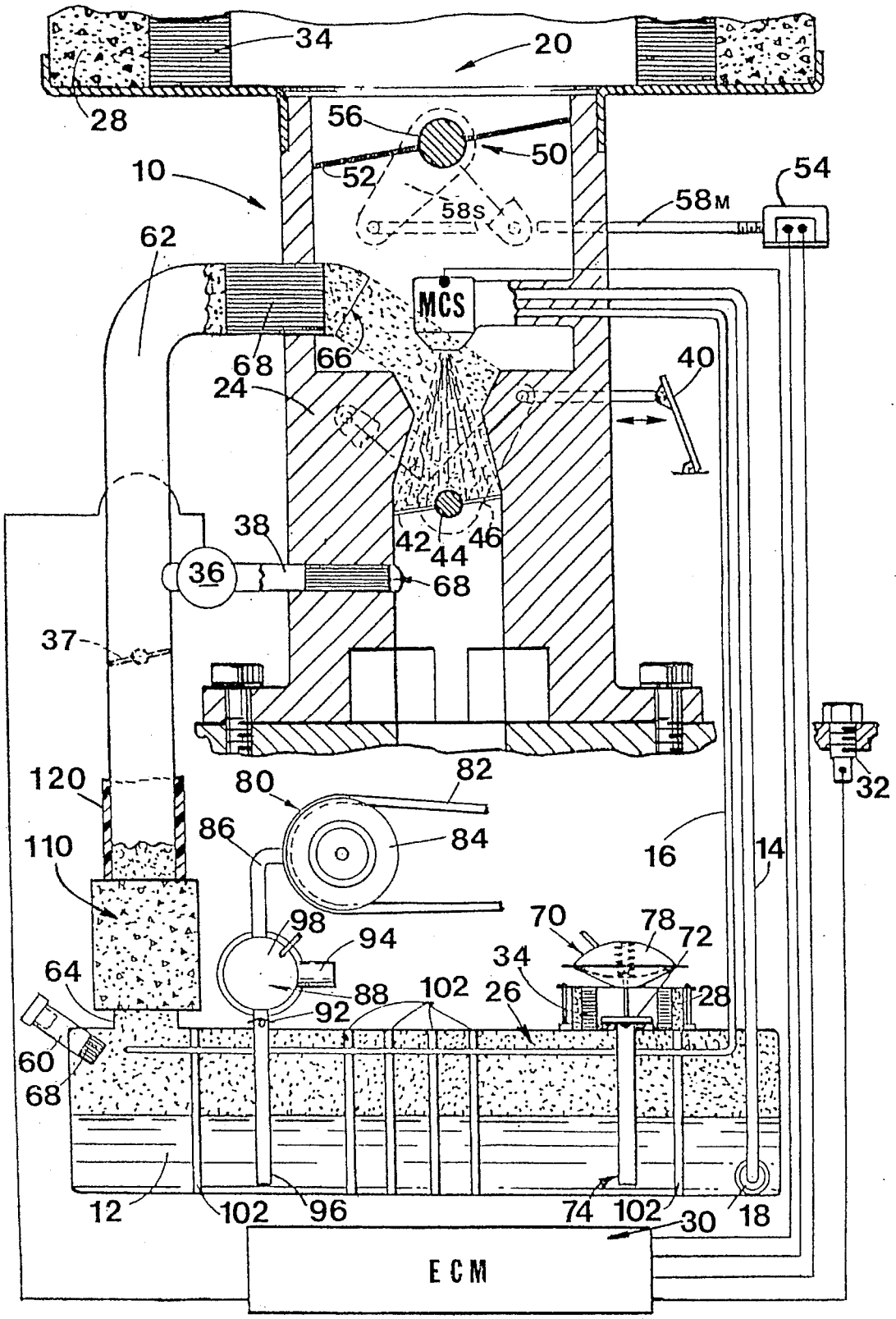
Figure 2:
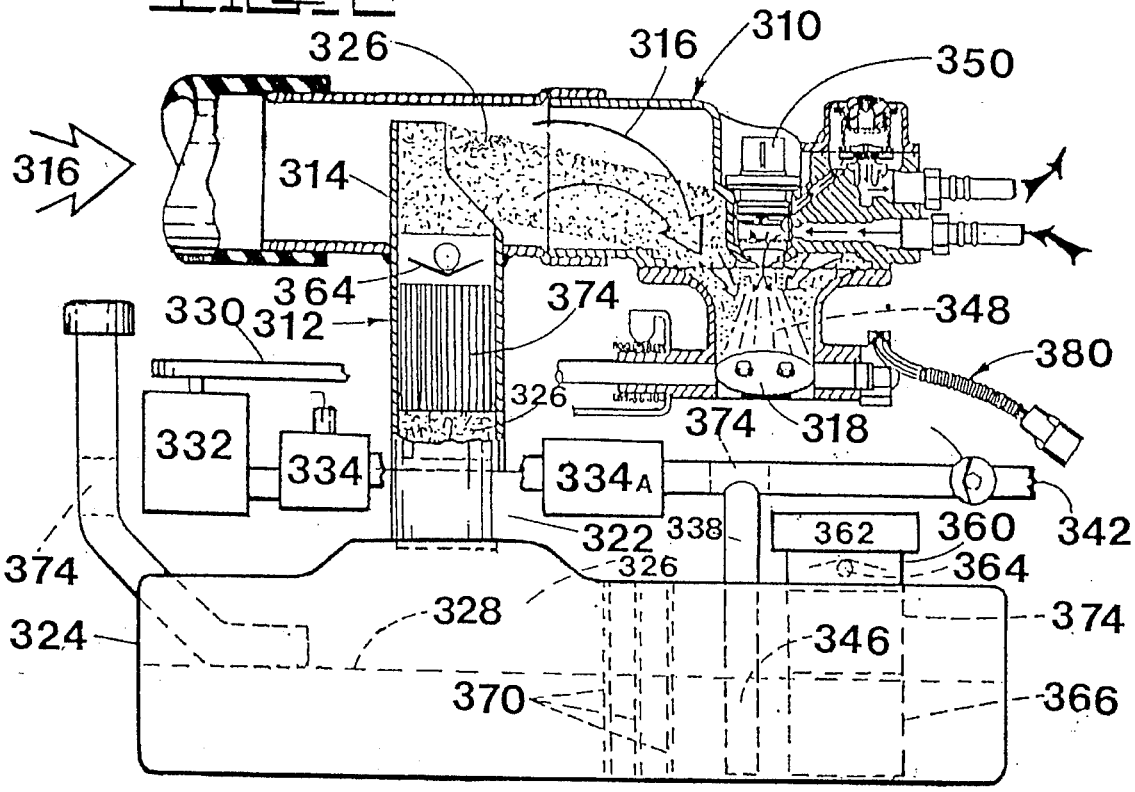

In FIG. 2 of the drawings, we see a diagramatic view of a Ford Motor Company throttle body electronic fuel injector, which has been modified in accordance with the teachings of the fuel delivery system shown in FIG. 1. The reference characters used are the same, but in a 300, three digit series. The throttle body fuel injector 310, has a secondary unmetered evaporated gaseous state introduction fuel delivery system 312 which is cooperable therewith. This permits the simultaneous controlled delivery of a vaporized liquid fuel mist 348 into a distribution manifold (not shown), while the gaseous state evaporated fuel is drawn from the fuel storage tank 324 and the charcoal canister therein (not shown). Since the liquid fuel vaporized mist 348 and the evaporated gaseous state fuel 326 are delivered above the throttle plate 318, the volume of unmetered fuel/air mixture is determined by the displacement of the throttle plate 318, while the resulting mixture control is determined by the operational mode of the system in either the open or closed loop modes as delineated in FIG. 4, A, B and C. The more detailed mode of operation is shown in FIG. 5 of the drawings, wherein the inputs from a plurality of data measurements generated by the operation of an internal combustion engine are fed into the microprocessor and sorted, so that when the input data meets the programmed criteria in block "A", the output from the electronic control unit microprocessor will cause a shifting from the open loop mode of block "C" into the closed loop mode of block "B" or visa versa, as controlled by the voltage outputs of the system. The fuel delivery system, either of domestic and/or foreign manufacture comes with the vehicle at its time of manufacture, as does the liquid fuel storage tank 324, and are used in concert with the added unmetered fuel/air communicating induction passages.

In FIG. 2 of the drawings, we see the modified throttle body fuel injection system, as used by the Ford Motor Company, which has been modified in accordance with the teachings of the fuel system shown in FIG. 1. The dual state fuel delivery system has installed, positioned and secured one end of a flexible or rigid pipe 314, or a combination thereof disposed between the induction air intake 316 of the engine (not shown) and the adjacent down stream throttle valve 318. The opposite end 322 is positioned and secured to the liquid fuel supply source 324 in communication with the evaporated gaseous state fuel 326 contained therein. When an Air Induction Reactor (A.I.R.) system is used for the control of exhaust gas emissions, the air pump 332 and control valves 334 and 334*a* can then be used to serve a dual function. To accomplish this, we must secure a a flexible or rigid pipe 338, or combination thereof, to the air pump outlet 342 intermediate one or both of the check valves 344 in the lines which communicate with the catalytic converter (not shown). The other air outlet end 346 thereof is then positioned and secured either above or below the surface of the liquid fuel 328 in the fuel supply source 324. Thus, when the engine is started, the throttle valve 318 will be opened for engine operation, while the air pump 332, which is part of the Air Injector Reactor (A.I.R.) system, will function to pump a controlled volume of clean filtered air into the liquid fuel supply source 324. This will cause the evaporated fuel contained therein to be propelled through the first installed pipe 312, after which this gaseous fuel/air will be mixed with induction air in the air path 316, and then mixed with liquid vaporized fuel 348 before entering the manifold (not shown) and delivery to the engine for its combustion.

As previously indicated, the second pipe 338 can be positioned either above or below the liquid fuel surface in the fuel supply source 324, the location of which will determine the density of the generated evaporated gaseous state fuel charge being delivered to engine, while the electronic control module (ECM) 30 (not shown here) will function to reduce the demand for liquid vaporized fuel, while the fuel delivery system provides a larger volume of air-borne gaseous fuel for engine consumption, which improves engine fuel efficiency. When the throttle plate 318 closes engine speed is reduced, engine vacuum is increased so as to function control valves 334 and 334*a* in the Air Injection Reactor (A.I.R.) system, to shut-off the air being delivered to the fuel supply source 324 and diverting it back into the atmosphere. This decreases the gaseous state fuel delivery to the engine, to prevent an overly rich fuel/air mixture. Other controls may be employed and incorporated herein without departing from the spirit and scope of the invention.

As in FIG. 1, any air introduced into the liquid fuel supply source 324 via the air pump or thru the normally closed vent means 360 when the inner end thereof 366 is disposed below the liquid surface 328 will create a turbulence and result in a more dense evaporated gaseous state fuel charge to the engine, while a lesser density charge is delivered when the vented air just passes over the liquid fuel. Also in the interest of safety, flame arrestors 374 should be installed throughout the gaseous fuel delivery system, in fuel passages 312 and 360 at each of the respective ends thereof, as well as in any other fuel entry and exit locations. One way normally closed check valves 364 should likewise be positioned in similar locations to prevent the escape of any evaporated gaseous or vaporized fuel into the atmosphere.

Figure 3:
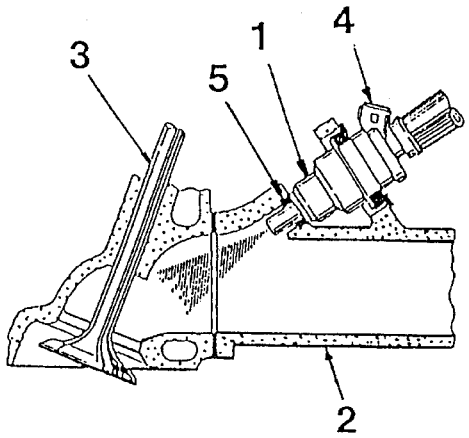
FIG. 3 illustrates a single multi-port fuel injector taken from page 6E3-179 of the 1984 General Motors Buick Service Manual, showing the liquid vaporized mist being injected into the combustion air intake passage, while the evaporated gaseous state fuel/air is introduced through the intake manifold.

FIG. 3 illustrates the construction of one of a single cylinder electronic fuel injectors (1), used in a multi-port fuel injection system. The liquid fuel vaporizing injector (1), is located in the intake manifold (2), adjacent to the intake valve (3) therein. The electrical terminal (4) on the injector (1) is energized in accordance with the signal generated through the electronic control module (ECM) connected therewith, although not shown. An "O" ring (5) is provided intermediate the fuel injector (1) and the manifold (2) to prevent the escape of any liquid vaporized fuel into the atmosphere during engine operation, as well as when the engine is inoperative. This type of construction is used by General Motors Corporation in their multi-port electronic fuel injection systems, with very similar type structures being used by other domestic and foreign vehicle fuel system manufacturers.

Other features of the proposed invention will permit normally closed atmospheric vent closure means to be incorporated into the removable fuel filler cap on the fuel tank 324. The fuel filler cap may also contain an air filter and/or a flame arrestor that would function as a reusable air filter at the same time.

The carburetor, although used for many years does not adequately vaporize the liquid fuel metered therethrough. This is also true for throttle body and multi-port injectors. Fuel injectors are superior to the carburetor because of their ability to control electronically the fuel/air ratio much more accurately. The fuel mist delivered has a wide variety of droplet sizes. The smaller droplets break up, become airborn and are able to negotiate the curves in the manifold, while the larger droplets travel in a straight line and deposited on the sidewalls of the manifold. The raw fuel ultimately finds its way to the crankcase, causing carbon deposits, crankcase dilution, sludge and varnish, none of which are very beneficial to efficient engine operation. With the evaporated gaseous state fuel being delivered to the engine, the resulting homogeneous fuel/air mixture can negotiate the path to the combustion chamber, thus eliminating the raw fuel condensation problems. This increases fuel economy and engine life, while reducing engine maintenance costs and exhaust gas emissions at the same time. Additionally, the induction air can be ionized and heated before mixing with the gaseous and vaporized fuel, after which it could be subjected to ultrasonic atomization as it moves through the fuel delivery system 10 before combustion.

With continued vehicle operation, testing and observation, we have now established several unique results which confirm the previous description of this much needed innovation by industry, as well as the public. Although the internal combustion engine (not shown) has been operated successfully with a variety of electronic fuel delivery systems that incorporate both multiport and throttle body designs such as the ones shown in FIGS. 2 and 3 respectively, we have not located any systems which consume large volumes of evaporated gaseous fuel 326 generated in the fuel tank. When the engine is rendered inoperative, the generated gaseous fuel vapors 326 are temporarily stored in an on-board activated charcoal canister which has been illustrated. The stored gaseous fuel vapors in the charcoal canister are rapidly withdrawn, both from the canister and fuel tank when the engine is operated. The withdrawn gaseous fuel vapors are then delivered to the operating engine via the air introduction system, to be mixed with the liquid vaporized fuel mist 348, wherein the fuel air mixture from both sources is more efficiently consumed by the engine.

It will be remembered that most of the activated charcoal canisters now in use, although illustrated, have limited and restricted gaseous entry exit means 56 provided therein. This, of course makes it difficult to remove the gaseous contents therefrom and results in a pressure build-up inside the fuel tank for the purpose of inhibiting evaporation.

That which follows will make the fuel system described in this application more understandable. The reason for inhibiting fuel vaporization in the past was to make possible the use of a much smaller canister that is less costly to manufacture. Thus, the the restrictive vapor entry passage would not permit rapid entry, which would increase vapor pressure in the fuel source to limit and restrict the evaporative process in the closed fuel system. Conditions have changed since the inception of first Clean Air Act, and they are about to change again with the passage of a new CLEAN AIR ACT before the end of 1990. New environmental standards will require the development of alternative clean burning fuels, lower exhaust gas tail pipe emissions, all of which will be coupled with improved engine efficiency and fuel economy. This, of course presents a serious ecological problem world wide.

As previously stated, this patent application delineates a much improved fuel delivery system which incorporates a closed circuit, vented fuel tank system for the operation of an internal combustion engine which has a mechanically operated throttle valve 42 or 318 for the controlled delivery of an evaporated gaseous fuel which is generated in a liquid fuel storage tank as the throttle valve is opened, while simultaneously therewith, variable volumes of electronically metered pressurized liquid vaporized fuel is injected into said internal combustion engine, while the added evaporated gaseous and more combustible fuel ingested by said engine functions to improve combustion efficiency. The oxygen sensor then functions to reduce the quantity of the less combustible non-gaseous liquid vaporized fuel, without any change in the oxygen content of the fuel delivered and consumed by the engine, which accounts for the improved combustion efficiency. Thus, the entry of all fuel being delivered to the engine is under the control of the electronic fuel delivery assembly and the mechanical displacement of the throttle valves 42 and 318 respectively for the regulation of engine speed. In view of this, there is really no need for the inclusion of an air by-pass means for the provision of additional combustion air below the throttle valves, the use of which results in increased engine speed because of increased demand for pressurized fuel vapor indicated by the oxygen sensor located in the exhaust system. This of course increases vehicular speed and and takes control away from the driver, with the end result being sudden unintended acceleration, of which we have heard so much about in a wide variety of both foreign and domestic production vehicles. This proposed devolvement will operate in both the open and closed loop modes of operation, while at the same time will provide quantities of evaporated more combustible gaseous fuel for starting the engine in any climate, despite the reduction vapor pressure of the fuel being used. The closed, but vented fuel tank provides for continued generation of gaseous fuel vapors 26 and 326, during periods of engine operation, while providing sufficient storage capacity for generated fuel vapor in an activated charcoal canister when the engine is inoperative (parked). By such new design, we have effectively provided a gaseous fuel delivery system which the existing pressurized injection system. The operation of which will function the oxygen sensor 32 to reduce the demand for liquid vaporized fuel while maintaining full control of engine speed at all times, with a more efficient clean burning fuel with reduced exhaust emissions. At the same time, the fuel source generated gaseous fuel air mixture introduced into the engine is always proportional to the mechanical displacement of the throttle valves 42 and 318 shown in FIGS. 1 and 2 respectively.

Should it be desirable to further enhance the combustibility of the generated gaseous fuel vapor to improve performance and driveability, while at the same time reducing production costs, this too can now be accomplished. If we keep and maintain the large evaporated gaseous fuel outlet 66 in passage 62, while at the same time reduce the size of the of the gaseous outlet 64 from the fuel tank 12, it will increase the velocity of the gaseous fuel 26 that is passed therethrough. This, of course will enhance the evaporation process, while at the same time cool the gaseous charge passing through, which will densify the fuel charge delivered to the said engine and provide a more homogeneous mixture to increase engine power output, making possible improved performance at any and all engine speeds. Therefore if we have and maintain a controlled relationship between the area of the induction air inlet and the evaporated gaseous fuel outlet into the induction path, whatever that relationship might be, depending on engine size, performance, emissions and economy desired, which will be different for each engine manufacturer because of the large number of variables that will be encountered. More efficient engine operation will be the result in each and every instance. The maintenance of the differing relationships will result in providing increased engine torque throughout the full rotational speed of any engine on which this fuel delivery system installed. The end results will be outstanding without the use of costly and noisy multivalve structures and without the use of superchargers or turbochargers which are costly and have a relatively short lift expectancy, coupled with a high replacement cost. During the experimental testing of one vehicle, the enhanced fuel combustion efficiency was such that the engine would idle smoothly without stall as low as approximately one hundred (100) revolutions per minute (RPM) while providing tremendously fast acceleration capacity and capability at any high or low operational speed. Thus, any engine that performs well at any speed, without substantial modification, or the addition of the cumbersome and costly mechanical devices above described will not only be safer and less costly, it should be welcomed not only by industry, but also by the environmentalists who have been actively working for all of the above without success, not only in the United States, but throughout the world.

During a recent television program, an engine mechanic was answering questions relative to the build-up of foreign material beneath the the throttle plate on the sidewalls of the fuel injector. Although the writer observed this condition on an unmodified test vehicle having a multiport injection system, the advice given to resolve this problem was quite disturbing. The so called solution to this build-up was to apply a spray-on solvent directed into the open throat of the fuel injector and allow the solvent to remain for a short duration, after which the engine would operated for a short period of time, which was then supposed to remove the build-up during the engine operation.

However, since the fuel delivery system is designed and made from a wide variety of metal, plastic and elastomeric components, such a simple answer to a problem such as this could destroy the the fuel delivery system, as well as destroy and damage the plastic and elastomeric components, while functioning to corrode various metallic components.

While the writer dismissed this observation previously noted, it was because the build-up was inadvertently eliminated by the solvent action of the evaporated gaseous fuel passing thereover and around the throttle valve during engine operation, without any potential damage to any of the various components since the system was designed to be compatible with the use of hydrocarbon fuels, which represents another advantage for the use of the above identified devolvement.

Having thus described my invention, I claim:

1. In an electronic, dual state fuel delivery system for the operation of an internal combustion engine having a combustion air induction system for the controlled delivery of a metered quantity of vaporized liquid fuel/air mixture in variable amounts for the operation of said internal combustion engine, the improvement of, an atmospherically vented fuel storage tank containing liquid fuel therein, along with evaporated gaseous fuel that is generated therewithin;

a large hollow conduit member communicating the evaporated gaseous state fuel directly into the combustion air induction system along with reduced controlled quantities of said liquid vaporized fuel/air mixture to compensate for the increased volume of gaseous evaporated fuel delivered via said large hollow conduit member.

2. A system as in claim 1, wherein venting means are installed in said liquid fuel storage tank that automatically open with engine operation and close when the engine is inoperative, so as to eliminate any potential for the escape of any gaseous fuel into the atmosphere.

3. A system as in claim 2, wherein an electronic liquid metering and vaporizing means is used to supply the controlled fuel/air mixture.

4. A system as in claim 3, wherein the fuel/air mixture is liquid vaporized fuel mist under the variable control of the electronic liquid metering and vaporizing means.

5. A system as in claim 2, wherein a moisture trap is installed on the venting means.

6. A system as in claim 2, wherein air filter means are provided for the venting means.

7. A fuel delivery system as in claim 1, wherein evaporated gaseous state fuel entry into the combustion air delivery system occurs above the throttle plate located therein.

8. A fuel delivery system as in claim 7, wherein electronic control means are used to determine both the time and volume of the evaporated gaseous state fuel that will be introduced into the said internal combustion engine.

9. A fuel delivery system as in claim 1, wherein the gaseous state fuel communicating means into the combustion air delivery system is of substantially the same dimensions throughout its length.

10. A fuel delivery system as in claim 1, wherein the evaporated gaseous state fuel communicating means is of different sizes.

11. A fuel delivery system as in claim 1, wherein an evaporated gaseous fuel entry located above a throttle plate opens only after the engine is operated in excess of a pre-determined rotational speed, closing during a period of deceleration.

12. A fuel delivery system as in claim 11, wherein the gaseous state fuel entry means is located above the throttle plate opens only after the engine reaches a pre-determined operating temperature.

13. A fuel delivery system as in claim 1, wherein a variable delivery air pump is selectively operated to enhance the evaporation of the liquid fuel contained in the liquid fuel storage tank;

an electronically controlled fuel injection means is used to provide liquid vaporized fuel and to function and control the air pump for the purpose of reducing the demand for liquid vaporized fuel, while substituting evaporated gaseous state fuel therefore and thus increase engine combustion efficiency.

14. A fuel delivery system as in claim 13, wherein a pulley driven air pump is employed and the variable output is controlled and communicated via hollow conduit means into the liquid fuel contained in said liquid fuel source, the turbulence created thereby enhancing the evaporative process when pumped air is released into the liquid via multiple orifices in said hollow conduit which are of similar size.

15. In a fuel delivery system having a liquid and evaporated gaseous state fuel source coupled with an electronically controlled liquid fuel metering and vaporizing fuel injection system to maintain both a fixed as well as a variable fuel/air ratio mixture for operating an internal combustion engine, the combination of, an automatically opening vent means for said fuel source when said engine is operating, which closes automatically when the engine is inoperative;

a combustion air intake means located upstream of the liquid vaporizing fuel injection system and the engine;

a hollow conduit means communicating said evaporative gaseous state fuel source with said combustion air intake designed to permit controlled rapid removal of any generated gaseous state fuel from the liquid fuel source to said engine;

the electronic control means functioning to compensate for the additional gaseous state fuel communicated to the engine, thus reducing the demand for liquid vaporized fuel to increase engine combustion efficiency.

16. An electronically controlled fuel delivery system as in claim 15, wherein an activated charcoal canister is positioned between the liquid and the evaporated gaseous state fuel source and said combustion air intake means to adsorb any generated vapors when the engine is inoperative, with any adsorbed gaseous vapors contained therein and in the fuel source, which will be rapidly removed via the hollow conduit when the engine is re-started

17. A fuel delivery system as in claim 15, which is operational with a commercial throttle body fuel injector system, as well as any multi-port system of domestic and foreign manufacture.

18. A fuel delivery system as in claim 15, wherein a large atmospheric vent valve means is operated by a solenoid, as is a small restricted vapor valve to control the function a charcoal canister.

19. A fuel delivery system as in claim 18, wherein the combustion fuel/air intake is electronically controlled in an open and closed loop mode of operation by a electronic control module (ECM) to control the purging said fuel source, as well as an activated charcoal canister;

a canister purge valve blocks a vacuum source for a pre-determined time during the open loop mode as well as below a pre-determined rotational speed of said engine;

after the said pre-determined time has elapsed and the proper rotational engine speed is reached, the fuel delivery system will be functioned in the closed loop mode when the ECM is actuated;

the ECM control then functions to rapidly exhaust said gaseous state fuel/air communicated to said engine, thus reducing the systems demand for liquid vaporized fuel to increase engine efficiency.

20. A fuel delivery means as in claim 19, wherein a second activated charcoal canister is disposed intermediate the evaporated gaseous state fuel storage tank and the combustion air intake, while a larger solenoid controlled valve is positioned between said second canister and the induction fuel/air inlet to the said engine.

21. A fuel delivery system as in claim 17, wherein atmospheric temperature controlled means will permit actuation of a large solenoid vent when an ignition switch is energized, for momentary evaporated gaseous state fuel enrichment under cold start conditions in an open loop mode of operation.

22. A fuel delivery system as in claim 19, wherein said gaseous evaporated fuel is introduced into the air induction system of the engine only when said engine is operating in the closed loop mode.

23. A fuel delivery system as in claim 17, wherein a large atmospheric vent and automatic closure means are provided and disposed in the removable fuel filler cap on the liquid fuel storage tank.

24. A fuel delivery system as in claim 17, wherein an air filter means is provided in a fuel filler cap on said liquid fuel storage tank to minimize any entry of foreign material into a liquid fuel storage tank.

25. A fuel delivery system as in claim 23, wherein a flame arrestor is located in a fuel filler and may also function as a re-usable air filter on the liquid fuel storage tank.

26. In a much improved fuel delivery system which incorporates a closed fuel circuit and a vented liquid fuel supply source for the operation of an internal combustion engine, the combination of, a mechanically operated throttle valve for the controlled delivery of evaporated gaseous fuel generated in said vented liquid fuel supply source;

in addition, the mechanical displacement of said throttle valve permits the introduction of variable quantities of electronically metered and pressurized liquid vapor fuel to be injected into said internal combustion engine for its operation;

simultaneously therewith, the more combustible evaporated gaseous fuel is mixed with the injected vaporized fuel and consumed in the engine, which automatically causes the oxygen sensor to compensate for the additional gaseous input by reducing the amount of metered fuel delivered without fuel enrichment, additional air, or change in engine speed, while at the same time improving combustion to maintain total fuel delivery in accordance with the established electronic program for maximum efficiency.

27. A fuel delivery system as in claim 26, wherein the mechanical displacement of the throttle will independently control engine speed, assisted by the electronically controlled fuel delivery system, while constantly reducing the excess vaporized fuel delivered in favor of delivering gaseous evaporated fuel generated in the vented fuel storage tank.

28. An apparatus for improving the fuel economy of an internal combustion engine having a vented liquid fuel supply tank which also contains as evaporated gaseous state fuel therein that is generated from said liquid fuel, the combination of, an electronically operated fuel/air mixture control means for the delivery of variable volumes of liquid vaporized fuel from the liquid fuel storage tank, while the evaporated gaseous state fuel is delivered to said engine via a large passage communicating said storage tank with a combustion air induction system to said engine, whereafter the liquid vaporized and gaseous state fuel is more efficiency burned in the said internal combustion engine.

29. An apparatus as in claim 28, wherein the fuel delivery passage for the evaporated gaseous state fuel has a controlled closure valve therein for limiting entry of said gaseous fuel into said engine when the engine is operating under differing conditions, the delivery passage may be insulated to prevent the potential of any condensation therein.

30. An apparatus for improving the combustion efficiency of an internal combustion engine as in claim 28, wherein an electronic control module (ECM) controlled closure valve is positioned in the evaporated gaseous state fuel passage to prevent the indiscriminate delivery of gaseous state fuel under certain engine operating conditions, while allowing rapid removal of said gaseous fuel from the storage tank and an activated charcoal canister in the system used for the storage of vapors when the engine is inoperative.

31. An apparatus for improving combustion efficiency in an operating internal combustion engine as in claim 28, wherein a magnetic clutch driven variable volume air pump is operated intermittently to produce a more densified fuel/air mixture ratio of gaseous state fuel for the operation of said engine;

the volume of said gaseous state fuel being determined by an electronic control module (ECM) functioned by an oxygen sensor located in the exhaust system of the engine.

32. An apparatus as in claim 28, wherein a pre-determined quantity of acetone is introduced into a columnar container;

acetylene gas is then introduced into the columnar container which also contains liquid gasoline, as the gas is bubbled therethrough and absorbed in the liquid gasoline, any gas not absorbed is re circulated through the liquid through the vented end of the columnar container.

33. A fuel delivery system as in claim 10, wherein the outlet of the gaseous fuel passage remains large, while the outlet communicating the fuel source evaporated gaseous fuel into the large passage into induction passage is of a reduced dimension to increase the velocity of the gaseous fuel passing therethrough, which will enhance the evaporative process and at eh same time cool the gaseous charge so as to density the delivered fuel and provide a more homogeneous fuel/air mixture to increase engine power output and improve performance at all engine speeds.

34. A fuel delivery system as in claim 33, wherein any build-up of a foreign material beneath a throttle valve will be eliminated by the passage of evaporated gaseous fuel therearound, without damage to the fuel system which will operate to reduce service maintenance.

* * * * *